US010344512B2

(12) United States Patent
Bertani

(10) Patent No.: US 10,344,512 B2
(45) Date of Patent: Jul. 9, 2019

(54) HINGE WITH DEFINED HALT POSITIONS

(71) Applicant: ELESA S.p.A., Milan (IT)

(72) Inventor: Alberto Bertani, Monza (IT)

(73) Assignee: ELESA S.p.A., Milan (IT)

( * ) Notice: Subject to any disclaimer, the term of this patent is extended or adjusted under 35 U.S.C. 154(b) by 0 days.

(21) Appl. No.: 15/833,202

(22) Filed: Dec. 6, 2017

(65) Prior Publication Data

US 2018/0155971 A1 Jun. 7, 2018

(30) Foreign Application Priority Data

Dec. 7, 2016 (IT) ..... 102016000124482

(51) Int. Cl.
*E05D 11/10* (2006.01)
*E05D 3/02* (2006.01)
*E05D 5/10* (2006.01)

(52) U.S. Cl.
CPC ..... *E05D 11/1064* (2013.01); *E05D 3/02* (2013.01); *E05D 2005/102* (2013.01); *E05D 2011/1035* (2013.01); *E05Y 2201/638* (2013.01); *E05Y 2800/292* (2013.01); *E05Y 2800/298* (2013.01); *E05Y 2900/132* (2013.01); *E05Y 2900/20* (2013.01); *E05Y 2900/608* (2013.01)

(58) Field of Classification Search
CPC ..... E05D 11/06; E05D 11/08; E05D 11/082; E05D 11/084; E05D 11/10; E05D 11/105; E05D 2011/1064; E05D 2011/1035; E05Y 2201/638; E05Y 2800/298; E05Y 2900/132; Y10T 16/5345; Y10T 16/54038; Y10T 16/54028
See application file for complete search history.

(56) References Cited

U.S. PATENT DOCUMENTS 2,591,476 A * 4/1952 Swanson ..... E05D 11/1064 16/307
3,000,049 A * 9/1961 Terry, Jr. ..... B29C 45/0017 16/334
4,630,333 A * 12/1986 Vickers ..... E05D 11/082 16/338
5,109,572 A * 5/1992 Park ..... E05D 11/105 16/334
5,409,297 A * 4/1995 De Filippo ..... B60N 2/757 297/411.32
5,412,842 A * 5/1995 Riblett ..... E05D 5/12 16/250
5,636,462 A * 6/1997 Kleiman ..... G09F 7/20 248/126
5,765,263 A * 6/1998 Bolinas ..... E05D 7/0423 16/250

(Continued)

*Primary Examiner* — Chuck Y Mah
(74) *Attorney, Agent, or Firm* — Pearne & Gordon LLP

(57) ABSTRACT

Hinge for the support and the maneuvering of doors, made up of two wing elements and provided with means for attachment to a frame part and respectively to a door portion, as well as mutually reinforcing means in a pivoting zone, the means being constituted by appendices internally hollow in the form of a cylindrical body projecting from the wing elements, characterized in that at least one of the appendices of the wings provides on the inner surface axial grooves suitable for housing a push-engagement element housed inside a pivot pin of the wing elements and protruding from it.

8 Claims, 5 Drawing Sheets

(56) References Cited

U.S. PATENT DOCUMENTS

| | | | | | |
|---|---|---|---|---|---|
| 5,918,347 | A * | 7/1999 | Morawetz | E05D 11/1071 | 16/274 |
| 6,314,614 | B1 * | 11/2001 | Kuehl | E05D 11/084 | 16/340 |
| 6,481,056 | B1 * | 11/2002 | Jesse | E05D 11/1057 | 16/321 |
| 6,560,821 | B2 * | 5/2003 | Miller | E05D 5/0246 | 16/252 |
| 6,609,273 | B1 * | 8/2003 | Yamada | F16C 11/02 | 16/332 |
| 6,766,561 | B1 * | 7/2004 | Cheng | E05D 5/0246 | 16/235 |
| 6,766,563 | B2 * | 7/2004 | Lee | A23B 7/0425 | 16/281 |
| 7,461,432 | B2 * | 12/2008 | Lowen | E05D 11/1071 | 16/334 |
| 7,536,750 | B2 * | 5/2009 | Lin | G06F 1/1616 | 16/321 |
| 7,805,811 | B2 * | 10/2010 | Shuker | E05D 5/128 | 16/380 |
| 8,099,832 | B1 * | 1/2012 | Shuker | E05D 11/1071 | 16/319 |
| 8,307,513 | B1 * | 11/2012 | Fitzgerald | E05D 11/06 | 16/344 |
| 8,752,247 | B2 * | 6/2014 | Franchini | E05D 11/105 | 16/334 |
| 8,959,717 | B2 * | 2/2015 | Billings | F16D 7/002 | 16/334 |
| 2007/0214605 | A1 * | 9/2007 | Tu | G06F 1/1616 | 16/342 |

* cited by examiner

HINGE WITH DEFINED HALT POSITIONS

TECHNICAL FIELD

The present invention concerns a hinge which has multiple halt positions, i.e. a hinge which can remain stationary in an intermediate position without the help of outer mechanical supports, such as for example hooks, chains, or other elements which need to be mounted.

BACKGROUND OF THE INVENTION

Hinges of this type are available on the market, and they are employed in industrial equipment, for example for the connection of hoods of mechanical equipment to the frame, or of doors to automatic vending machines, to electric cabinets, to banking devices, or in protection carters, access gates or the like.

This type of hinge was met with considerable success on the market, also in the light of the fact that it meets the need of operators and maintenance personnel of having a gate, or a hood, which keeps an open, secure position, however chosen, and that it does not interfere—if only incidentally—with the action thereof.

The hinges thus made found on the market provide a system of mutual engagement of two hinge elements, consisting of locking elements between a central pivot and one—or both—hinge elements. Thrust springs are provided, made of steel or rubber, which are associated with further additional elements, such as for example steel spheres and screws.

U.S. Pat. No. 5,412,842 owned by Southco Inc. concerns for example a conventional-type hinge, wherein suitable means are provided apt to retain in specific mutual positions the two hinge wings. Said devices consist of a spring-sphere pair, housed in the wall-fastened wing, and of holes and grooves provided on the wings so that the sphere-shaft coupling keeps the door in a predefined secure position, unless a strong pressure is imparted on the gate.

However, such a solution is particularly complex to accomplish, since all the recesses obtained must be perfectly in axis to be able to effectively lock the gate, and since rather difficult mounting operations are necessary, with the risk that the sphere departs from its seat during the installation.

Furthermore, since the engaging means are basically made of steel, they are complex to be realized and have a poor tribologic coupling. Finally, the springs apt to drive the spheres are partially in sight: therefore, an unexpected shock could unlock them from the original position, for example during the transport phase or the mounting phase. Such an event could affect the functionality of the means.

In order to make the hinge structure simpler, the Applicant duly submitted Italian patent no. 1365898, aimed at protecting a hinge having multiple halt positions, the hinging elements of which provided on the respective wings have on the engagement surfaces ribs and longitudinal recesses in mutual engagement. This invention, which substantially provided to insert no retaining element, proved particularly useful in case of relatively light loads, but it highlighted some problems on heavier loads In order to solve this matter, the applicant has filed the Italian patent 1398735, apt to describe a novel solution, in which the thrust element was inserted inside a slot provided on the wing without the grooved cylindrical body, and consisted of an elastic element at X ending at a wedge end. The steady engagement between the two wings was granted by the engagement of the wedge with the groove provided onto the cylindrical body and by the elastic force of an X-shaped element provided upstream the wedge element. After the application of a force to a movable door (that is, to the wall fixed to the movable door) the wedge element tends to shrink, in order to allow the detachment of the said wedge from the groove provided on the cylindrical element of the other wing.

However, also this solution appears rather difficult to realize, and shows several disadvantages during the mounting phase, because the correct placement of the engagement elements could become difficult: as a matter of fact, this kind of hinge is relatively small in size.

Furthermore, this solution appears particularly subjected to the changes in temperature and humidity of the environment in which it is used, since the elastic force of the X-shaped element it is connected to the properties of the plastic material with which it is used.

Therefore, it is object of the present invention to find a new type of hinge with defined halt positions, which is capable of overcoming the above-said disadvantages, and in particular which provides a sealing system easy to manufacture and mount, which is capable of keeping the hinge in a secure position when it is in the desired preset position, with no limitation to the borne load, and which it is independent of the environment in which it is used.

The above-said object is achieved through a hinge for door support and maneuvering, consisting of two wing elements, provided with means for fastening to a frame part and to a door part, respectively, as well as mutual-hinging means in a pivoting area, said means consisting of appendixes projecting from said wing elements, wherein said appendixes are shaped as a hollow cylindrical body characterized in that at least one of said appendixes of said wings has axial grooves provided on the internal surface, said grooves being apt to accommodate a thrust element inside a pivot member of said wing elements and protruding from said pivot element. The dependent claims refer to preferential feature.

BRIEF DESCRIPTION OF THE DRAWINGS

Other features and advantages of the invention will in any case be more evident from the following detailed description of some preferred embodiments, given purely by way of a non-limiting example, and illustrated in the attacked drawings, wherein:

FIG. 1 shows a front view of the hinge ready for installation, of which

FIG. 4 is a front view of one of the two wings of the hinge according the invention, of which

FIG. 6 is a front view of the wing opposed to the wing depicted in FIG. 2, of which

DESCRIPTION OF A PREFERRED EMBODIMENT

Figure 1:
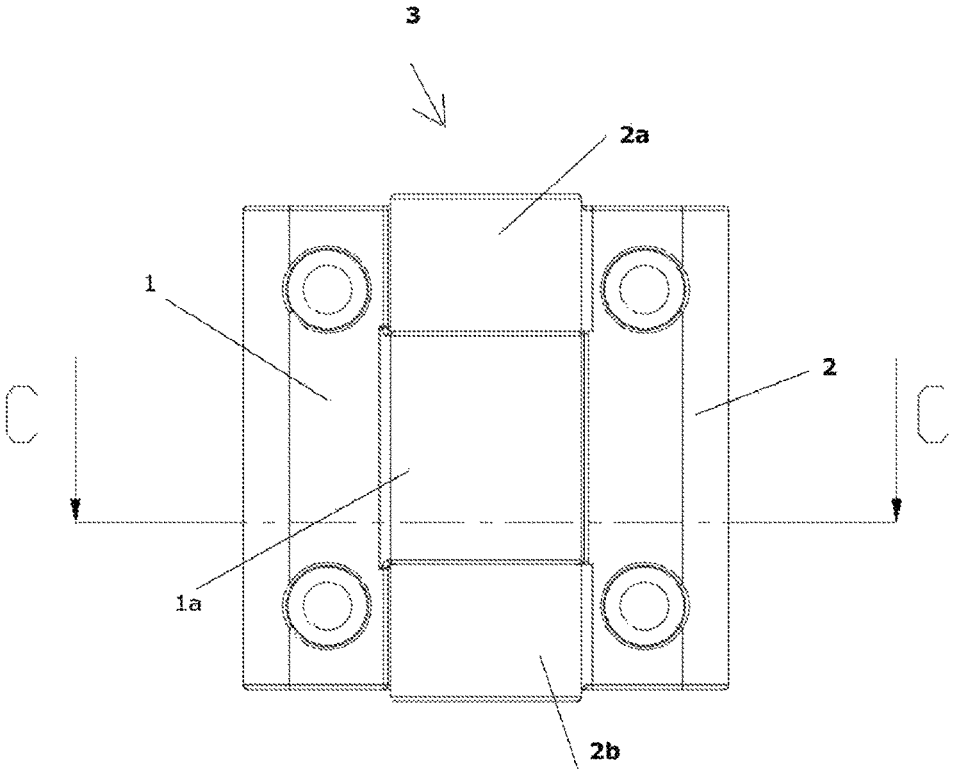

The hinge according to the invention consists of two main elements 1 and 2, which can be identified as wings or as hinge bodies-generally molded of thermoplastic material, but which can be made also of other synthetic materials, or of rubber or of metal-shaped so as to have a mutual engagement area 3, into which a pivoting element 4 is introduced.

The mutual engagement area 3 consists of the association of respective appendixes which project from both wings: in particular a cylindrical body 1*a* projecting from wing 1 is provided, and a pair of bushes 2*a*, 2*b*, projecting from wing 2, for the introduction and the sealing of pivoting element 4.

Pivoting element 4 is axially mounted starting from one of the ends and is fastened by means of constraint elements (not shown, known per se).

According to a first feature of the invention, the pivot element 4 consists of a cylindrical body, externally shaped with a polygonal base and provided along the external wall with a slot 6 apt to house an halt system composed of a wedge element 7 and a harmonic shock absorber 8, such as a spiral spring (as will be defined below, for simplicity purposes contained in it.

Figure 2:
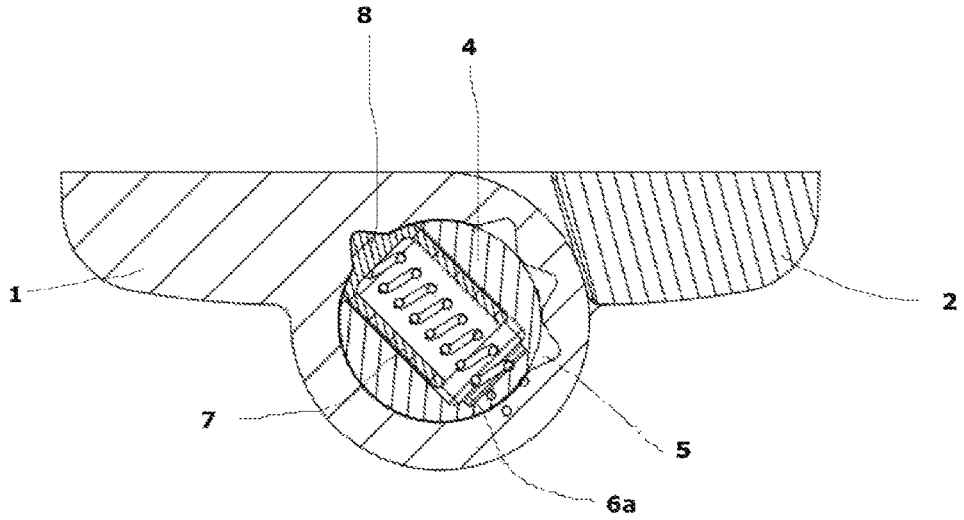
FIG. 2 is a section view along line C-C.

As it can well observed in the section of FIG. 2, the wedge element 7 is internally hollow, in order to house inside it at least a spring element 8, firmly maintained in position at the two ends in the beating surface 7*a* of said element 7 and at the bottom wall of said slot 6. In such a way, it will be granted that the system composed by the element 7 and the spring element 8 is perfectly and autonomously functional, after the insertion of the pivot element 4.

Figure 5:
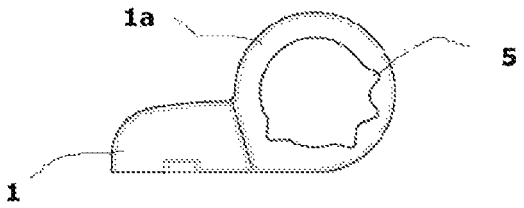
FIG. 5 is a top view.
Figure 6:
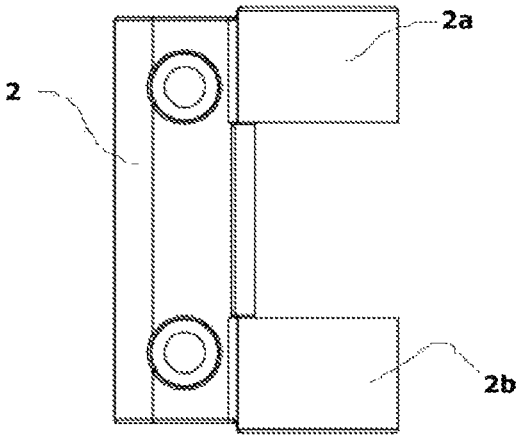
Figure 7:
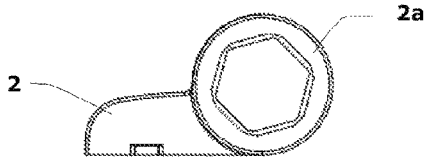
FIG. 7 is the top view.

FIG. 2 and, more precisely, FIG. 5 show the shape and the location of the said axial grooves 5 located within said cylindrical appendix 1*a* acting as a engagement member of the wing 1: particularly, it could be noted that the corresponding blunt profile in order to help the sliding movement of the door, and with the vertex defined to guarantee the steady position of the wedge element 7.

Figure 8B:
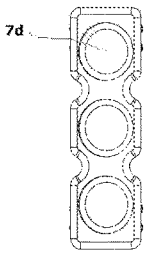
FIG. 8*a*-8*d* are respectively lateral view, rear view, sectional view along the A-A line and front view of the thrust element of a particular embodiment of the invention.
Figure 8D:
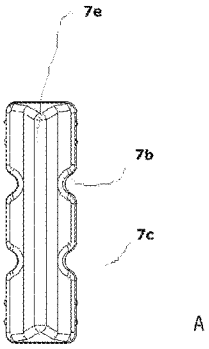
Figure 8A:
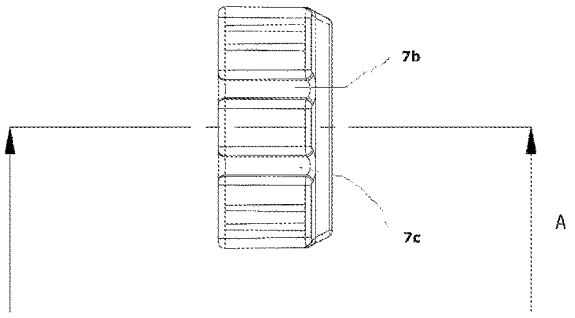
Figure 8C:
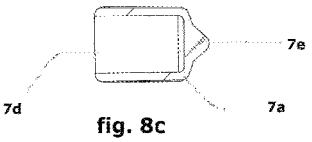

In the specific embodiment of FIGS. 8*a*-8*d*, it is shown a wedge element 7 having a specific tripartition, defined by the presence of two facing couples of external grooves 7*b*, 7*c* that surround at it is well illustrated in FIG. 8*b* three identical cavities 7*d* apt to house identical spring elements 8, said spring elements being characterized also in an identical load. On the topo of each cavity 7*d* it is provided the beating surface 7*a*. Finally, the tip 7*e* is provided on the top of the wedge element 7, said tip 7*e* having substantially triangular shape, with the contour slightly blunt. Said conformation is apt to guarantee the correct engagement with the groove 5; contemporarily, it guarantees the easy disengagement.

It could be noted the front housing of the beating surface 7*a* for the spring 8, in order to better comprehend the novel solution.

Figure 9A:
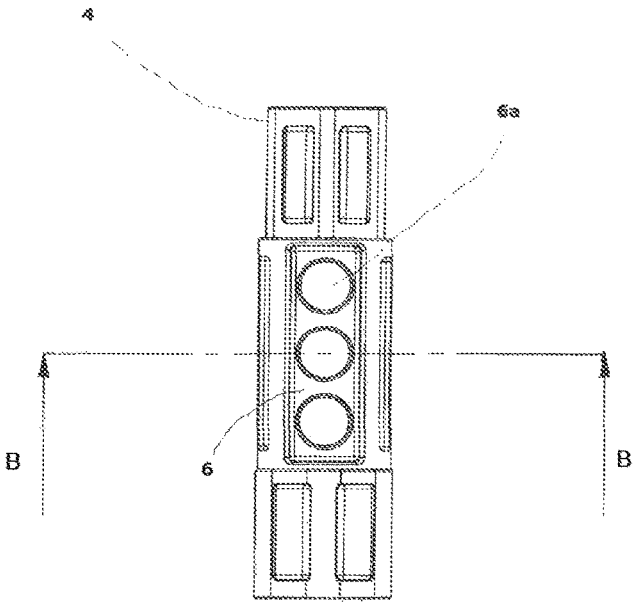
FIG. 9*a* a 9*c* are respectively front view, lateral view and sectional view along the line B-B of the pivot element according the invention.
Figure 9B:
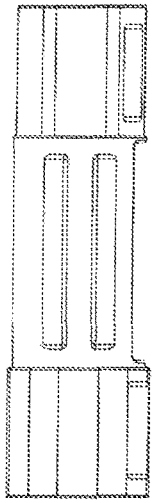
Figure 9C:
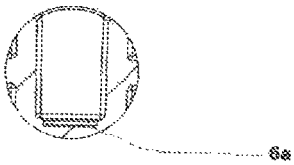

The pivot 4, shown in FIGS. 9*a* a 9*c*, is composed of a cylindrical body having at its ends a polygonal shaping and centrally bearing a housing slot 6 apt to move the halt system composed of the wedge element 7 and of the spring 8. The slot has a substantially rectangular profile and it provides on the bottom surface, a circular cavity 6*a* in order to house the spring 8, and to hold in place the same.

Figure 4:
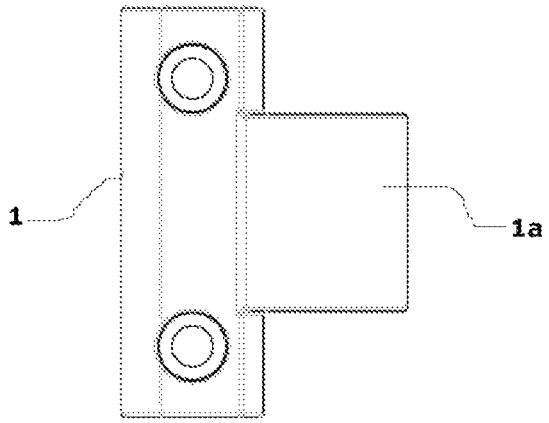
Figure 10A:
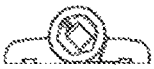
FIGS. 10*a* to 10*d* are perspective views aimed at showing the positions which the various embodiments of the hinge according to the invention can take up during operation, with various angles.
Figure 10B:
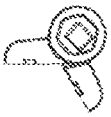
Figure 10C:
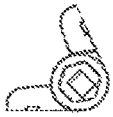
Figure 10D:
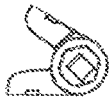

Further, as it is also shown in the operation of the FIGS. 10*a*-10*d*, the body 1*a* has a particular arrangement of the grooves 5, in order to obtain angles respect to the table top of the body 1, corresponding to the angles that the hinged door will take respect to the wall onto which the hinge was assembled. Particularly, in FIG. 4 the four preferred position are illustrated that are matching with the position usually requested by the market, i.e. 0° (FIG. 10*a*), 80° (FIG. 10*b*), +115° (FIG. 10*c*) and 150° (FIG. 10*d*).

Of course, the solution of a tripartite hinge is just described as an example: it could be provided more or less springs, likely at least one spring, maintaining the modular structure of the wedge element 7. Likewise, the number and the angle of the grooves 5 could vary according to the different requests of the client.

Figure 3:
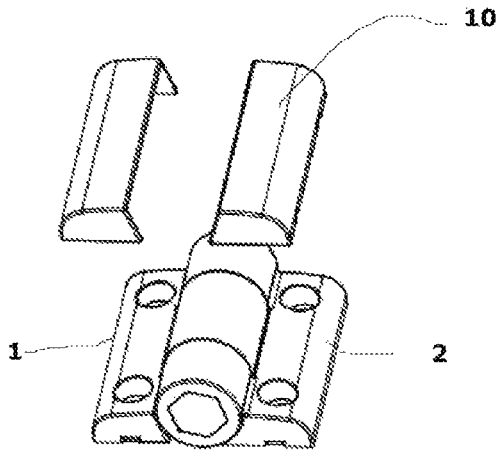
FIG. 3 is a partially removed perspective view of the hinge of FIG. 1.

Assembling the hinge is relatively easy: it is sufficient to insert the springs 8 in the wedge element 7, in order to house the assembly obtained in such a manner inside the slot 6 provided into the pivot element 4. Subsequently, the worker inserts the pivot element 4 inside the reciprocating zone 3, and plugs the pivot elements 4 at the ends. After the adjustment of the wings to the door and to the wall of the machine, the worker defines—just pushing—the screw-cover caps 10 shown in FIG. 3.

In such a way, the structure of the hinge is able to realize the objects desired, obtaining a hinge easy to mount, apt to resist to high pressures in a stable position, and—contemporarily—apt to guarantee a correct movement of a door relative to the wall of a machine, maintaining pre-set positions.

Such a manufactured structure consents to overcome the solutions of the prior art, maintaining the spring element 8 hidden to the worker. This feature certainly appears pleasing to the eye, but it is also appears as a protective feature against the agents, like powder or humidity, that could limit the ability of the spring to operate in the correct manner.

Furthermore, the presence of housing chambers of the spring allows the operator to prepare a fast assembly, without the risk of misalignments and incorrect insertion of the wedge in position.

As it could be easily understood, all the elements that make up the hinge can be composed of any type of material apt to offer the desired characteristics of lightness and strength. In particular, the solution described up to now is totally composed of synthetic material, the only metal element being at most the amortizing body: however, the latter is very easy to assemble and is totally enclosed within the seats designated, significantly reducing wear or corrosion, and thus significantly increasing the life of the hinge.

Moreover, the angles that the hinge can assume in the operation may also be different from those shown in the figures, although obviously they must be pre-defined in the molding phase.

The invention claimed is:

1. A hinge for the support and the maneuvering of doors, the hinge comprising:

first and second wing elements provided with mutually pivoting means comprising appendices that are internally hollow and are in the form of a cylindrical body projecting from said first and second wing elements, wherein at least one of said appendices of said first and second wing elements is provided on an inner surface thereof with axial grooves suitable for housing a push-engagement element housed inside said pivoting means of said first and second wing elements and protruding from it, and wherein the push-engagement element comprises a wedge element and a harmonic shock absorbing body; and a pivot element comprising a substantially cylindrical body having, along a wall thereof, a slot configured to house said push-engagement element.

2. The hinge as in claim 1, wherein said wedge element is internally hollow, and the wedge element houses at least the harmonic shock absorbing body, said harmonic shock absorbing body being held in a steady place at two ends on a beating surface of said wedge element and on a bottom surface of said slot.

3. The hinge as in claim 1 wherein said slot has a substantially rectangular profile, and provides on a bottom surface thereof circular cavities apt to house said harmonic shock absorbing body.

4. The hinge as in claim 1 wherein said grooves are arranged in order to obtain an angle between the first wing element and the second wing element, said angle being equal to 0°, 80°, +115° and 150°.

5. The hinge as in claim 1 wherein said appendices are comprised of a cylindrical body projecting from the first wing element and a pair of bushes provided on the second wing element, said bushes being apt to insert and hold said pivot means.

6. The hinge as in claim 1 wherein said harmonic shock absorbing body is a coil spring.

7. A hinge for the support and the maneuvering of doors, the hinge comprising:

first and second wing elements provided with mutually pivoting means comprising appendices that are internally hollow and are in the form of a cylindrical body projecting from said first and second wing elements, wherein at least one of said appendices of said first and second wing elements is provided on an inner surface thereof with axial grooves suitable for housing a push-engagement element housed inside said pivoting means of said first and second wing elements and protruding from it, and wherein the push-engagement element comprises a wedge element and a harmonic shock absorbing body; and a pivot element comprising a substantially cylindrical body having along a wall thereof a slot configured to house said push-engagement element, wherein said wedge element is internally hollow and houses at least the harmonic shock absorbing body, said harmonic shock absorbing body being held in a steady place at two ends on a beating surface of said wedge element and on a bottom surface of said slot, and said wedge element comprises at least two facing couples of external grooves that surround at least three identical cavities, each of said cavities being configured to house said harmonic shock absorbing body on a top of each said cavity being provided said beating surface.

8. The hinge as in claim 7 wherein said wedge element provides two couples of grooves that contour three cavities apt to house respective harmonic shock absorbing bodies.

* * * * *